US006090452A

United States Patent [19]

Garst

[11] Patent Number: 6,090,452

[45] Date of Patent: Jul. 18, 2000

[54] CONVEYING DEVICE FOR PRESSURE TREATING WOOD

[75] Inventor: Frederick Garst, Rocky Mount, Va.

[73] Assignee: Rocky Top Wood Perservers, Inc., Rocky Mount, Va.

[21] Appl. No.: 09/156,489

[22] Filed: Sep. 18, 1998

[51] Int. Cl.[7] ..... B05D 7/06; B05C 3/109

[52] U.S. Cl. ..... 427/440; 427/441; 118/50; 118/423; 118/428

[58] Field of Search ..... 427/440, 441; 118/50, 423, 428

[56] References Cited

U.S. PATENT DOCUMENTS

| | | | |
|---|---|---|---|
| 986,751 | 3/1911 | Paty . | |
| 1,229,439 | 6/1917 | Fuller . | |
| 1,499,791 | 7/1924 | Shipley . | |
| 2,118,966 | 5/1938 | Card | 427/441 |
| 2,430,641 | 11/1947 | MacKenzie et al. . | |
| 3,551,190 | 12/1970 | Myers . | |
| 4,086,056 | 4/1978 | Hanson . | |
| 4,191,795 | 3/1980 | Lewis . | |
| 4,343,840 | 8/1982 | Edwards et al. . | |
| 4,581,243 | 4/1986 | Kelsoe . | |
| 4,678,686 | 7/1987 | Park | 427/254 |
| 4,846,390 | 7/1989 | Masuda et al. | 118/423 |

*Primary Examiner*—Katherine A. Bareford
*Attorney, Agent, or Firm*—Staas & Halsey LLP

[57] ABSTRACT

A first tram loaded with wood is introduced at a first, loading end of a treatment chamber along a primary trackway. After treatment, the first tram is removed along the primary trackway from the treatment chamber to a second, opposite unloading end, while a newly loaded second tram is introduced into the chamber at the first end. After the treated wood is unloaded from the first tram, the empty first tram is returned to the first, loading end via a second trackway located under the chamber, parallel to the primary trackway. Pivotable bridges of the primary trackway selectively connect the primary and secondary trackways to allow the return of the unloaded tram to the loading end of the chamber.

52 Claims, 6 Drawing Sheets

CONVEYING DEVICE FOR PRESSURE TREATING WOOD

BACKGROUND OF THE INVENTION

This invention relates to wood treatment and, more particularly, to a conveying device which facilitates pressure treating of wood, and a related method.

Conventional wood preserving apparatuses have included a horizontally-oriented, cylindrical, pressurized treatment chamber or "autoclave," into which "charges" of lumber are placed. The lumber is moved on trams that run on small gauge railroad-like tracks. Various preserving chemicals flood the autoclave and the pressure therein is alternately lowered and increased to treat the lumber.

More particularly, a tram of untreated lumber is placed through one open door of the autoclave, another tram of untreated lumber is placed through the opposing open door at the other end of the autoclave, the doors are sealed and the wood is treated. The doors are then opened and each tram is pulled out the same end from which it was put in. The treating chemicals are allowed to drip off the treated lumber, the treated lumber is removed from the respective trams by, e.g., cranes, and new untreated lumber is placed on each tram, whereupon the process is repeated.

This method has at least two major disadvantages:

1) Having to load untreated and treated lumber on a tram at both ends of the autoclave precludes a smooth flow of lumber through the plant, and requires significant lumber handling;
2) Because the treating solution is a government regulated hazardous material, any surface over which the lumber passes in the first forty eight hours after treatment must have primary and secondary containment with monitoring of leakage. Such a "drip pad" area (usually about 100 feet by 300 feet) is many times more expensive than a standard floor slab.

Several attempts have been made to provide a smoother flow of lumber using a double door plant. For example, one apparatus replaces the trams and track with a powered roller conveyor which moves in only one direction from a non-hazardous material area, through the autoclave, and on to a drip pad area that is smaller than the conventional drip pad.

More particularly, this method includes driven spaced transverse rollers that rotate and advance the charges of lumber through the autoclave in one direction, i.e., in one end and out the other. The method is an improvement over the above-described tram and track version, but the following disadvantages are still associated with this alternate method:

1) If the rollers are driven by hydraulic motors inside the autoclave, cross contamination between hydraulic motor oil and treating liquid is inevitable and undesirable.
2) The drive shaft pressure seals of the rollers which enter the autoclave are damaged by the repeated autoclave pressure treatment.
3) Fitting the conveyor rollers inside the autoclave requires an increased internal diameter of a traditional autoclave. This results in a higher capital cost, plus the creation of much more wasted space in the autoclave, which must be filled with treatment fluid.

Although the prior art described above eliminates some of the problems inherent in the wood treatment art, this prior art still does not disclose or teach the most cost efficient apparatus or the most time-efficient method for treating wood.

SUMMARY OF THE INVENTION

Accordingly, it is a purpose of the present invention to provide an apparatus and a method for treating wood that require less handling of the wood.

It is another purpose of the present invention to provide an apparatus and a method for treating wood that require a smaller drip pan area than the commonly used apparatus and method.

It is another purpose of the present invention to provide an apparatus for treating wood that avoids the use of hydraulic fluid or pressure seals in the treatment chamber.

It is another purpose of the present invention to provide an apparatus for treating wood which does not require an enlargement of the treatment chamber.

It is another purpose of the present invention to provide a wood treating apparatus and related method of wood treatment that are more reliable, faster and relatively less costly than prior art apparatuses and methods.

It is another purpose of the present invention to provide an apparatus for treating wood which minimizes the amount of equipment necessary to move a wood tram from a wood pretreatment position, to a wood treatment position, and back to the wood pre-treatment position.

It is still another purpose of the present invention to provide an apparatus for wood treatment that requires less maintenance, is more compact and is less costly than the conventional apparatus.

It is yet another purpose of the present invention to provide an apparatus and a method for treating wood that avoid in-and-out movement of the wood, and instead rely upon forward feeding of the wood only.

It is another purpose of the present invention to provide a wood treatment apparatus that uses an articulated tram to facilitate transfer of the tram from a pre-treatment position, to a treatment position, and back to the pre-treatment position, all in a more compact operating area.

Finally, it is another purpose of the present invention to provide an apparatus and method for treating wood which include a first trackway for moving a wood-loaded tram from a first end of a treatment chamber, through the chamber, and to a second end, and a second trackway for moving the tram, from which the treated wood has been removed, back to the first end of the treatment chamber.

To achieve the foregoing and other purposes of the present invention there is provided a wood treating apparatus and method which utilize a primary trackway system for "one directional" operation, and returning the empty trams from an unloading area to the loading area via a secondary trackway located under the treatment chamber.

A first tram loaded with wood is introduced into a treatment chamber at a first end thereof while being conveyed on the primary trackway. After treatment, the first tram is removed via the primary trackway from the treatment chamber through a second, opposite end thereof, while a newly-loaded second tram is introduced into the treatment chamber at the first end. After the treated wood is removed from the first tram, the empty first tram is returned to the first end of the treatment chamber via the secondary trackway located under the chamber. In this regard, bridge portions of the primary trackway are pivoted downward at an angle to connect to and complete the secondary trackway. The tram can be articulated to facilitate movement thereof along the angled connections formed by these pivoted bridge portions relative to the trackways.

The benefits of this invention include:

1) Creating a one direction flow that requires less lumber handling;
2) Eliminating maintenance problems, such as pressure seals, etc., which are characteristic of a conveyor system; and 3) Lowering capital costs, through the use of a more compact operating area, eliminating the need for about 50 percent of the "drip" area required by the traditional two end load/removal method, eliminating the need for an enlarged treatment chamber necessitated by powered rollers, and allowing for lesser winch requirements.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

The present invention is directed to a wood treatment apparatus 10, and a related method of treating wood, which will be described below with reference to the FIGS. 1–8.

Figure 1:
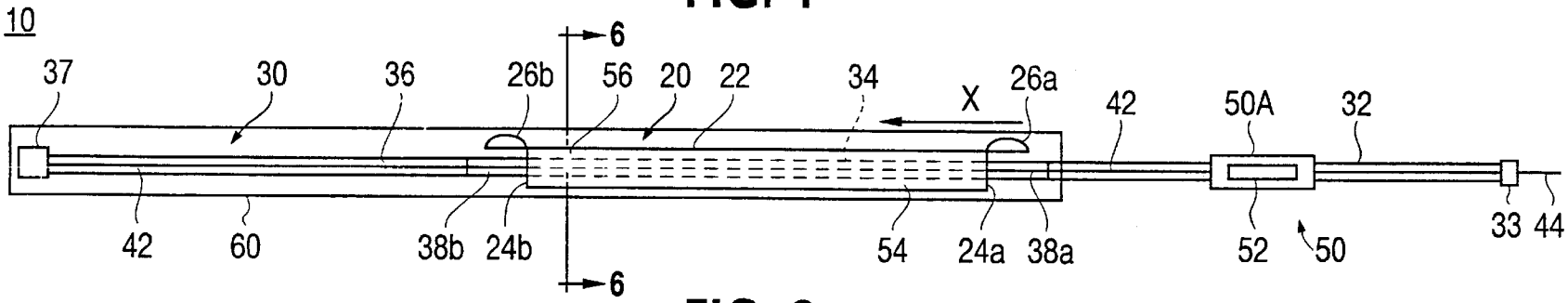
FIG. 1 is a schematic top view of the wood treating apparatus and method according to the present invention, illustrating particularly the primary trackway, a first tram loaded with wood, and open autoclave doors.
Figure 2:
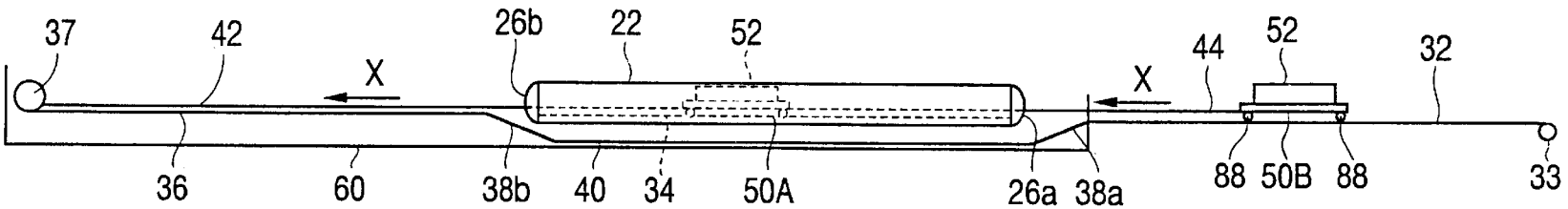
FIG. 2 is a schematic side view for explaining the wood treating apparatus and method according to the present invention, illustrating particularly treatment of wood on the first tram in the autoclave, and a second tram loaded with wood.

As shown in particularly FIGS. 1 and 2, the treatment apparatus 10 generally includes a treatment chamber 20, a primary trackway 30, a secondary trackway 40, a plurality of trams 50, such as 50A, 50B, each for carrying a charge of lumber 52, and a fluid collector 60.

The chamber 20 is a conventional, pressurized vessel for treating wood. The chamber 20 is usually about 80 feet long, and includes a cylindrical vessel 22 with two open ends 24*a* and 24*b*, each of which is closable in a pressure and fluid sealed relation by corresponding pivotable doors 26*a* and 26*b*, respectively. In addition, such chambers 20 include various inlets and outlets for changing the pressure therein, and introducing the treating fluid, which are well-known in the art, and the details thereof will not be repeated herein.

The primary trackway 30 includes a loading track 32, a chamber track 34 and an unloading track 36. The primary trackway 30 is generally a spaced beam type track which is straight and can accommodate a wheeled tram 50 thereal-ong. The length of the entire primary trackway is about three times the length of the chamber 20, which allows for an adequate lumber loading area at the loading track 32, an adequate area inside the chamber 20 to receive the tram 50 for treatment, and an adequate lumber unloading area at the unloading track 36.

Located at one end of the loading track 32, distal to the chamber end 24*a*, is a relatively small winch 33, which is responsible for moving an unloaded tram in the "Y" direction (FIGS. 4A–4C), as discussed below. Located at the other end of the apparatus 10, on the unloading track 36, is a relatively larger winch or electric donkey engine 37 which is responsible for moving a loaded tram in the "X" direction, (FIGS. 1–3), as also discussed below.

The primary trackway 30 also includes bridges 38*a* and 38*b* located between the loading track 32 and the chamber track 34, and between the chamber track 34 and the unloading track 36, respectively. The bridges 38*a* and 38*b* are normally engaged with these tracks 32, 34 and 36, in a co-linear and uninterrupted fashion. These bridges, however, can be lowered below the plane of the primary trackway 30 (see, e.g., FIG. 2), after a tram 50 that has been loaded with lumber at the loading track 32 and has been moved into the chamber 20, in order to allow the doors 26*a* and 26*b* to be closed and sealed. The lowered bridges 38*a*, 38*b* also serve the separate purpose of allowing easier return of an unloaded tram to the loading track 32, as described below.

The secondary trackway 40 extends below the chamber 20 in parallel relation to the primary trackway 30 (and the chamber trackway 34). The secondary trackway 40 can be connected to the primary trackway 30 to transport a tram 50 from the unloading side of the chamber 20 (track 36) to the loading side of the chamber 20 (track 32). That is, the bridges 38*b* and 38*a* are pivoted to connect the unloading track 36 and the loading track 32 with the secondary trackway 40, so that a tram 50 can be returned to the loading track 32, after a charge of wood 52 has been treated and removed from the tram 50 at the unloading track 36.

The fluid collector 60 extends only under the unloading track 36 and the secondary trackway 40. The loading side of the chamber 20 does not require any fluid collector, as the lumber 52 loaded on the tram 50A on the loading track 32 (FIGS. 1 and 2) has not yet been treated with the hazardous fluid substance, and the lumber 52 after treatment (compare FIG. 3 with FIGS. 4A to 4C) does not return to the loading side of the chamber 20. Accordingly, this collector 60, since it resides under only a portion of the treatment apparatus 10, as opposed to the prior art collector which resides under the entire trackway of the treatment apparatus, is less expensive to build, maintain and monitor.

Figure 5:
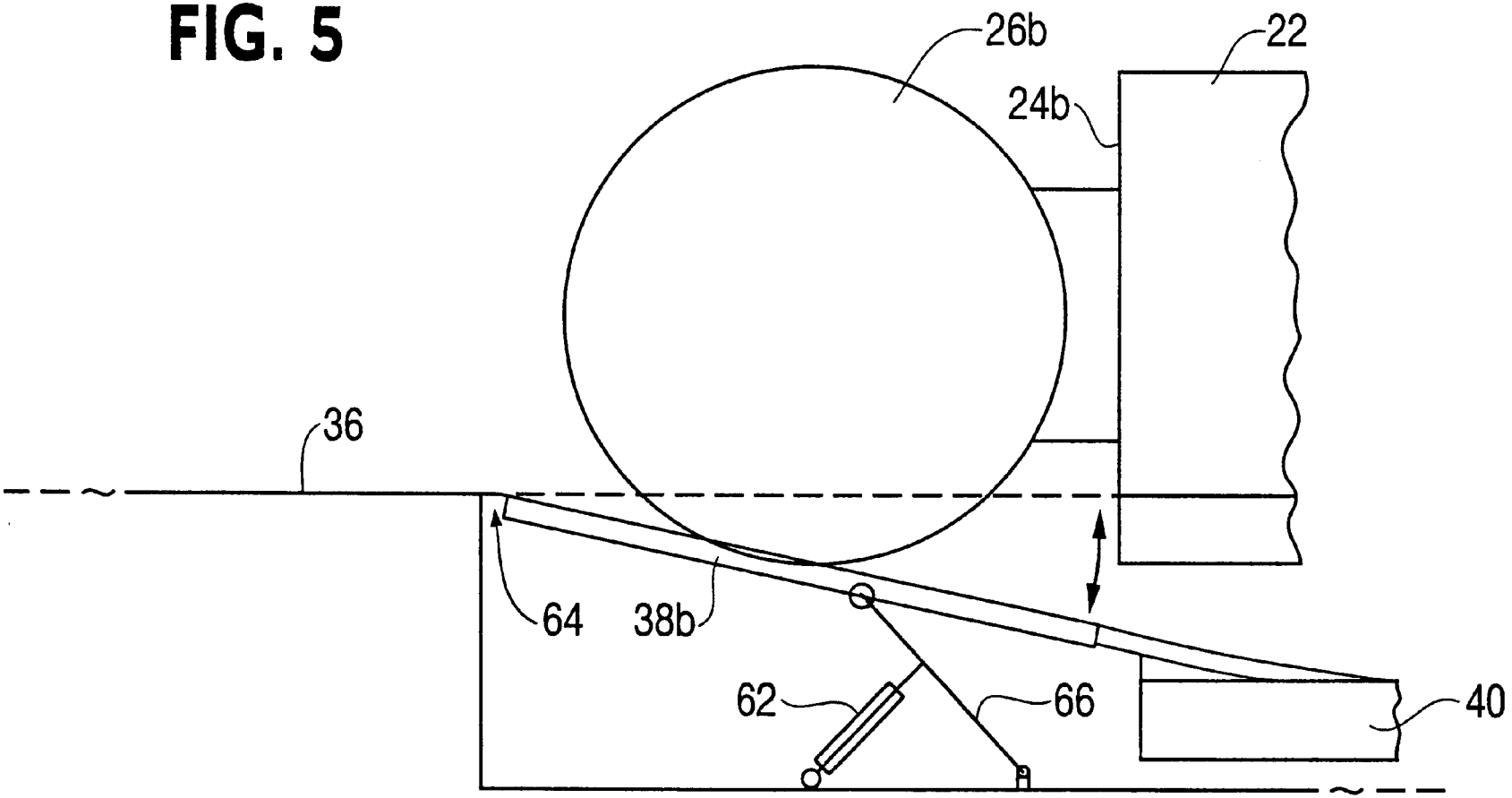
FIG. 5 is a side, schematic view of a bridge in a lowered position.

FIG. 5 is an enlarged view of the bridge 38*b* described above. The bridge 36*a* at the opposite end of the chamber 20 has a similar configuration. In this figure, the door 26*b* is shown open, and the bridge 38*b* has been pivoted downward to connect the unloading track 36 with the secondary trackway 40. As can be seen, it is preferred to use a mechanism such as a hydraulic cylinder 62 to move the bridge 38 between a first position co-planar with the primary trackway 30 and a second position at an angle to and connecting the unloading track 36 with the secondary track 40. Most particularly, the bridge 38*b* is rotated about a pivot point 64 via the hydraulic cylinder 62 working through an arm 66. When in this position, either the door can be opened or closed, as need be, or a tram 50 can be moved from the primary trackway 30 to the secondary trackway 40. Of course, after the tram 50 is returned to the loading track 32 from the unloading track 36 via the secondary trackway 40 the bridge 38*a* can be returned to its original co-planar position in the primary trackway 30.

Figure 6:
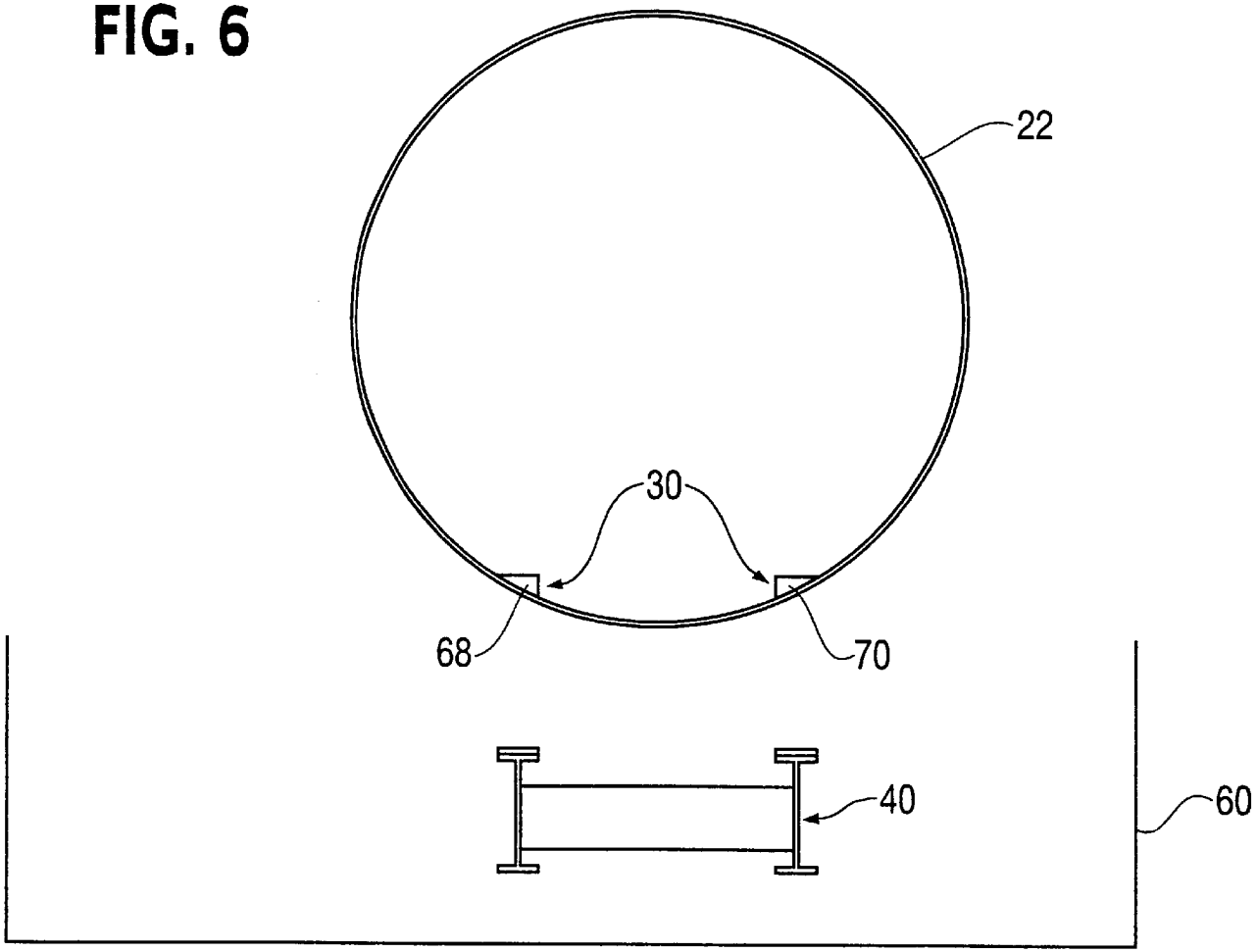
FIG. 6 is a transverse cross-sectional view of the treatment chamber and primary and secondary trackways shown in FIG. 1 taken along line 6—6.

FIG. 6 is a cross-sectional view taken along line 6—6 of FIG. 1. FIG. 6 shows the chamber 20 and portions of the respective primary (chamber track 34) and secondary trackways 30, 40, respectively, which are arranged in parallel planes. The primary trackway 30 in the chamber 20, i.e. the chamber track 34, is a pair of spaced platforms 68, 70 formed directly on the internal diameter of the vessel 22. The remainder of the primary trackway 30, i.e., the loading track 32 and the unloading track 34, as well as the secondary trackway 40 is basically a pair of parallel, steel "I" beams connected together by channels. Of course, wear plates can be placed on the tracks where the wheels 88 of the trams 50 ride.

Figure 7:
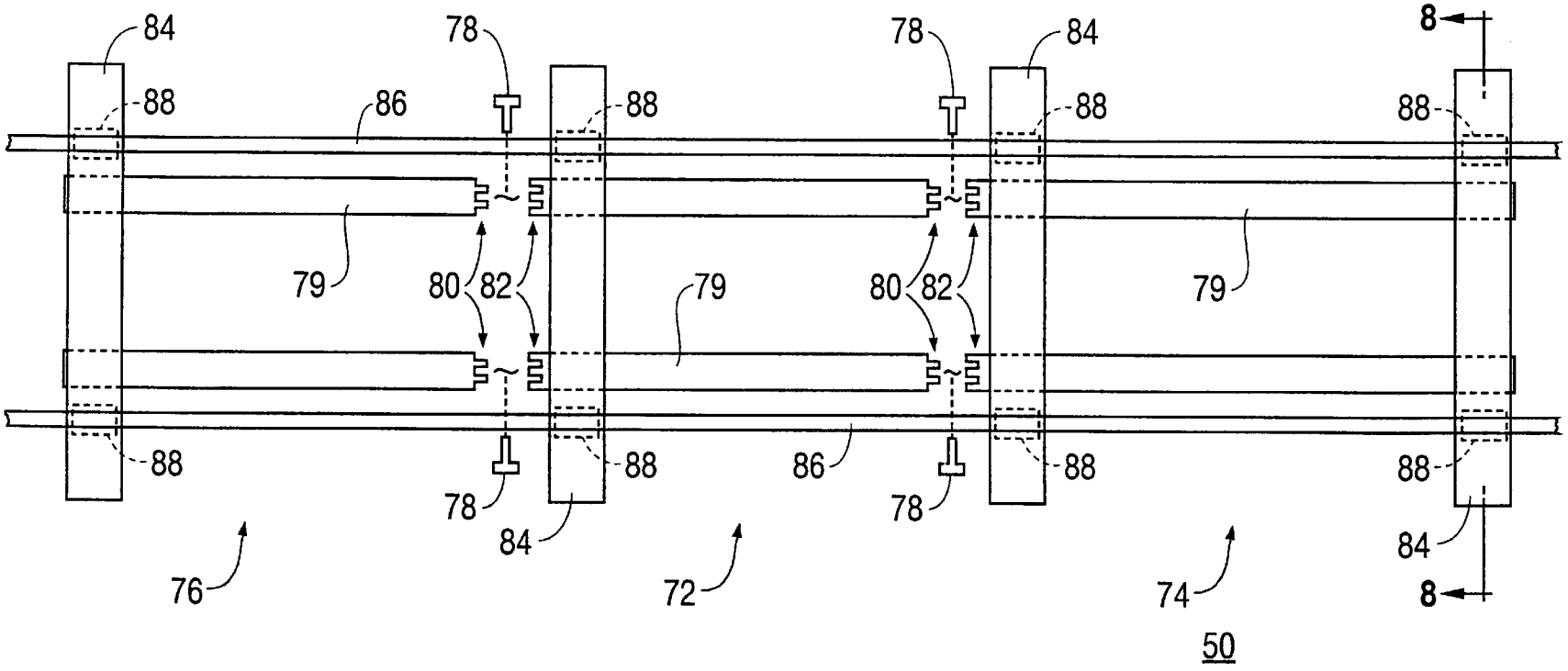
FIG. 7 is an exploded, top view of an articulated tram according to the present invention.
Figure 8:
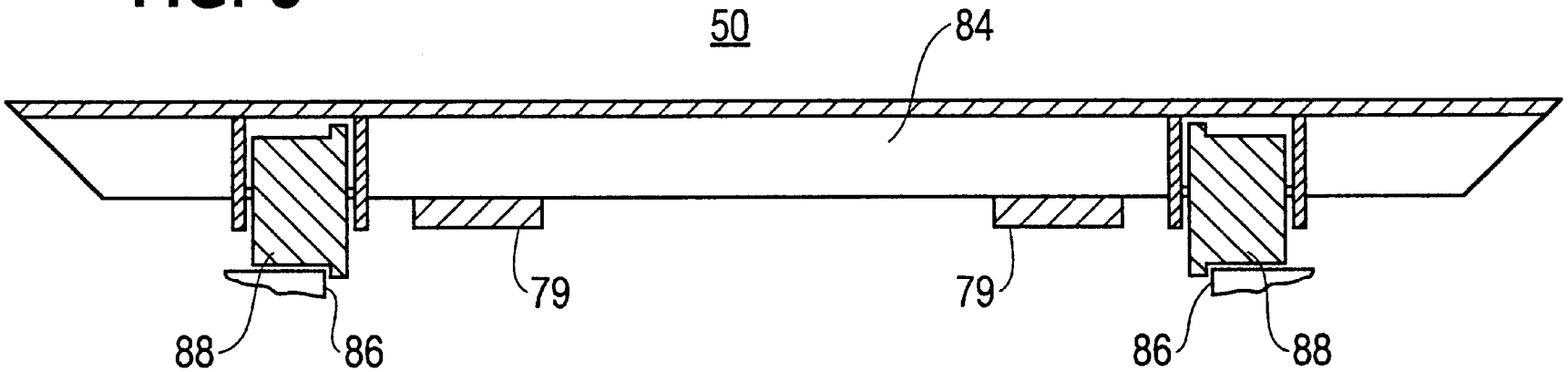
FIG. 8 is a front, cross-sectional view of a tram according to the present invention taken along line 8—8 of FIG. 7.

As noted above, each tram 50 can be articulated longitudinally to facilitate return of the tram 50 below the chamber 20, and to promote a more compact operating area. That is, as shown in FIGS. 7 and 8, each tram 50 can include a plurality of middle portion carts 72, e.g. eighteen such carts, and first and second end portion carts 74 and 76, respectively. The carts 72, 74, and 76 are connected by pivot pins 78 that extend through holes (not shown) at respective, spaced longitudinal members' 79 connected male 80 and female 82 joints. The longitudinal members 79 are connected by lumber supports or bolsters 84.

The end cart 72 preferably includes four wheels 88, each located at opposite corners at the bolsters 84 (see FIG. 8). The middle cart 72 and the other end cart 74 each include two wheels, one at each opposite end of the bolster 84.

FIG. 7 also shows a line 86 corresponding to the inside of the track upon which the trams 50 move.

As can be seen from FIGS. 7 and 8 particularly, these trams 50 are characterized by carts 72, 74 and 76 that are articulated about a horizontal axis perpendicular to the direction of travel (X, and Y as described below).

The articulated tram 50, when loaded and moving along the co-planar primary trackway 30, and when moving along the planar secondary trackway 40, remains planar. However, when the unloaded tram 50 moves between the unloading track 36 to the bridge 38*b*, or between the bridge 38*a* and the loading track 32, the end carts 74, 76 of the tram 50 can pivot relative to the middle cart 72.

The present method invention will now be described in greater detail with reference to the drawings.

According to the conventional apparatus and method as described above, two trams would be loaded with lumber separate loading tracks located at opposite ends of the treatment chamber. With the two doors of the chamber open, the trams would then be pulled into the opposite respective open ends of the chamber, each via respective large winches since each carries a heavy load. The bridges would then be lowered, and the doors closed. The conventional pressurized liquid treatment would then proceed. At treatment completion, the doors would be opened and the trams individually would be pulled out the same doors from which they entered, again using the separate large winches. The trams would then be allowed to sit outside the chamber so that the fluid can drip off and be collected in the all-encompassing collector 60. Then, the treated lumber is removed from each tram by respective fork lifts or cranes, and the entire process is repeated.

In contrast, according to the method of the present invention, and as particularly shown in FIGS. 1 and 2, the tram 50A is loaded with lumber 52, the door 26*a* of the chamber 20 on a first side 54 of the chamber 20 is opened, and the bridge 38*a* is put in the up position connecting the loading track 32 and the chamber track 34. The tram 50A is then pulled into the chamber 20 in lumber movement direction "X". This movement is effected by a winch 37 positioned on a second side 54 of the treatment chamber 20 and connected to the tram 50A by a cable, chain, etc. 42.

As also shown in FIG. 2, another tram 50B can be pulled in direction "X" onto the loading track 32 by attaching a cable, etc. 44 between trams 50A and 50B, so that, as tram 50A is being moved into the chamber 20, tram 50B is being pulled on the loading track 32. The cables 42, 44 are removed prior to closing the doors 26*a*, 26*b*. The two bridges 38*a* and 38*b* are then lowered to provide clearance for the doors 26*a*, 26*b*, and the doors are sealed shut. The tram 50A loaded with wood 52 is then treated. At the same time, the tram 50B is loaded with wood 52 that also requires treatment.

Figure 3:
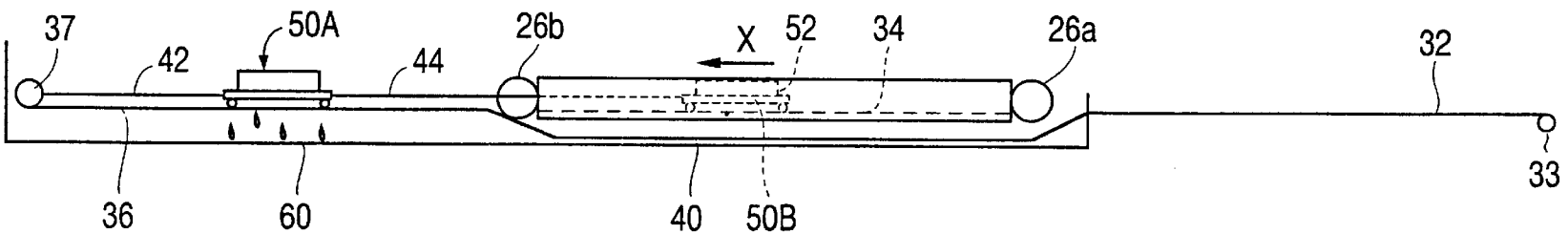
FIG. 3 is a schematic side view for explaining the wood treating apparatus and method according to the present invention, illustrating particularly the treated wood on the first tram dripping treatment fluid, and treatment of the wood on the second tram in the autoclave.

As shown in FIG. 3, after completion of the treatment of the wood 52 on the tram 50A, the door 26*b* at the second side 56 of the chamber 20, i.e., the unloading side, is opened, as is the door 26*a* on the first side 54 of the chamber 20. The tram 50A with the treated lumber 52 is pulled out the second side 56 of the chamber 20 in the direction "X" via the re-attached cable 42 and winch 37, and the newly loaded tram 50B is pulled concurrently into the chamber 20 in the same direction "X", via the cable 44 again connected between trams 50A and 50B. Of course, a third tram 50 (not shown), can be pulled onto the loading track 32, by being connected to the moving tram 50B, and loaded, just as described above for tram 50B.

Once loaded tram 50B is in the chamber 20, any cables are removed, the doors 26*a*, 26*b* of the chamber 20 are closed, and treatment of the lumber 52 on tram 50B occurs. In the meantime, tram 50A is allowed to sit on the unloading track 36 so that the excess treatment fluid can drip down into the collector 60.

Figure 4A:
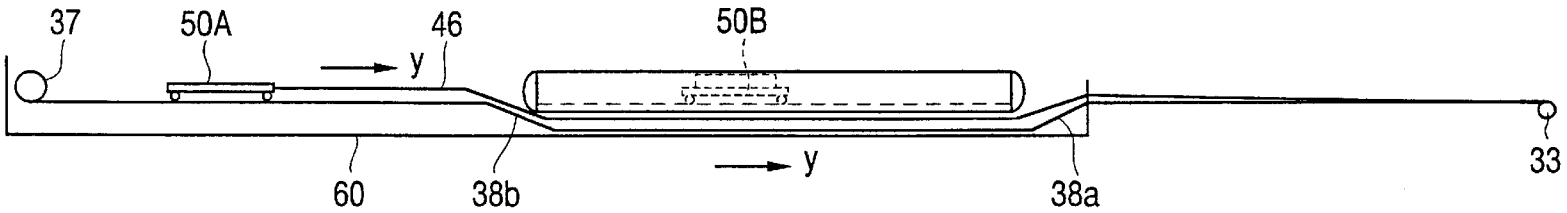
FIG. 4A is a schematic side view for explaining the wood treating apparatus and method according to the present invention, illustrating particularly the beginning of the return movement of the unloaded first tram.

FIG. 4A shows the tram 50A after the treated lumber 52 has been removed therefrom, and the treated lumber 52 on the tram 50B, which is awaiting removal from the chamber 20. At this time, the tram 50A is pulled in the opposite direction "Y" along the unloading track 36 via the smaller winch 33 that is hooked up to the tram 50A by a cable, etc. 46. The bridges 38*a*, 38*b* are in the down position, and the tram 50A moves down along the bridge 38*b*. As described below, this movement of the unloaded tram 50 is facilitated by articulation of the tram.

Figure 4B:
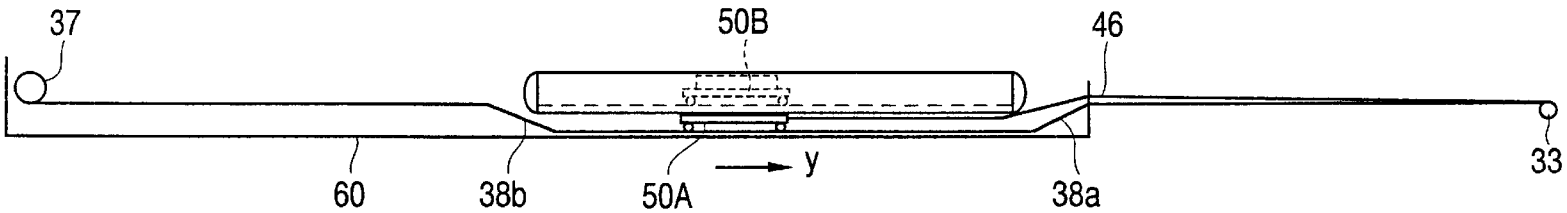
FIG. 4B is a schematic side view for explaining how the first tram moves along the secondary trackway.
Figure 4C:
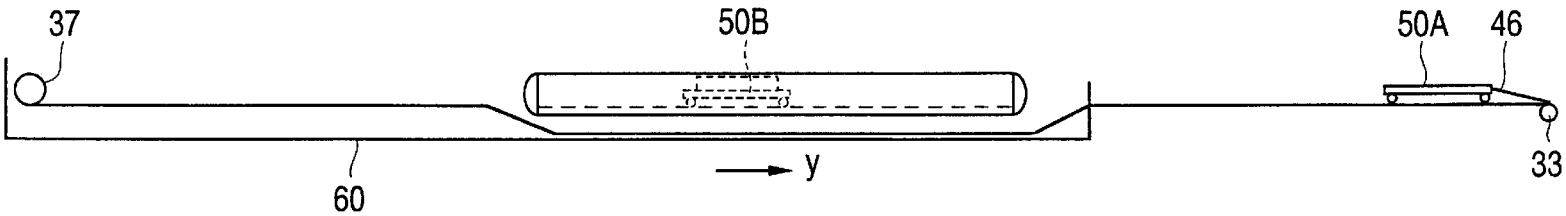
FIG. 4C is a schematic side view showing the first tram returned to the loading track area of the primary trackway.

As shown in FIG. 4B, the tram 50B then rides on the secondary trackway 40. As the tram 50A continues to be pulled in the direction "Y," the tram 50A moves up the bridge 38*a*, and is ultimately pulled onto the loading track 32, as shown in FIG. 4C. Once on the loading track 32, the tram 50A again serves as a tram to be loaded with lumber 52 for treatment in the chamber 20.

When the unloaded tram 50A is clear of the secondary trackway 40, the bridges 38*a*, 38*b* are returned to a co-planar position in the primary trackway 30. The tram 50B can then be moved out of the chamber 20 to the unloading track 36 to allow the fluid to drip off, just like the tram 50A described above.

Once the tram 50A is loaded again, and with the bridge 38*a* co-planar with the chamber track 34 and the loading track 32, the door 26*a* is opened, and the loaded tram 50A is again moved into the chamber 20. Thereafter, the bridges 38*a* and 38*b* are again lowered, the doors 26*a* and 26*b* closed, the wood 52 on the tram 50A is treated, and so on. The plurality of trams 50A, 50B, etc. thus continuously serve as loaded and unloaded trams, in succession, as they move from the loading track 32, to the chamber track 34 and to the unloading track 36 of the primary trackway to the secondary trackway 30, and from the unloading track 36, to the secondary trackway 40, and again back to the loading, respectively.

Based on this method, it is clear that the collector 60 does not have to be as large as the traditional trackway collector, which is on each side of the chamber 20, as well as under the chamber 20. Accordingly, the capitol cost for collector formation, and the costs associated with maintenance and monitoring thereof for government regulatory compliance is less with the present invention, when compared with the conventional apparatus and method.

Also, an unloaded tram is relatively light compared to a loaded tram. Accordingly, moving an unloaded tram back along the secondary trackway 40 to the loading track 32 requires relatively less effort than moving a loaded tram from the loading track 32 to the unloading track 36. Thus, the smaller, less expensive and easier-to-maintain winch 33 can be used at the loading side of the apparatus 10, as opposed to the larger winch 37 at the unloading side. The prior art apparatus requires two large winches to function, because each moved a loaded tram, at least some of the time.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A method for treating wood, comprising the steps of:

(a) loading the wood on a movable tram at a loading area at a first end of a closeable treatment chamber;

(b) moving the tram loaded with wood in a first direction along a first trackway extending into the treatment chamber and closing the chamber;

(c) treating the wood in the treatment chamber under pressure;

(d) moving the tram out of a second end of the treatment chamber in the first direction along the first trackway to an unloading area;

(e) unloading the treated wood from the tram;

(f) connecting the first trackway with a second trackway parallel to the first trackway and outside and beneath the chamber; and (g) moving the tram along the second trackway in a second, opposite direction, from the unloading area to the loading area.

2. The method as recited in claim 1, wherein step (c) comprises the step of sealing the treatment chamber and introducing fluid therein under pressure.

3. The method as recited in claim 2, wherein step (d) is followed by a step of allowing fluid on the wood to drain substantially from the wood.

4. The method as recited in claim 1, wherein the step (f) comprises the step of moving a member in the first trackway into engagement between the first trackway and the second trackway.

5. A method for treating a wood material, comprising the steps of:

(a) loading the wood material on a movable receiver at a loading area at a first end of a pressurizable treatment chamber;

(b) moving the receiver loaded with wood along a first trackway in a first direction into the treatment chamber;

(c) treating the wood material in the treatment chamber that has been pressurized;

(d) moving the receiver out of a second end of the treatment chamber in the first direction along the first trackway to an unloading area;

(e) unloading the treated wood material from the receiver;

(f) connecting the first trackway with a second trackway located beneath the treatment chamber by pivoting a member from the first trackway to the second trackway; and (g) moving the receiver along the second trackway in a second, opposite direction, from the unloading area to the loading area.

6. The method as recited in claim 5, wherein step (c) comprises the step of sealing the treatment chamber and introducing fluid therein under pressure.

7. The method as recited in claim 5, wherein step (d) is followed by a step of allowing fluid on the material to drain substantially from the material.

8. An apparatus for treating wood, comprising:

a pressurizable treatment chamber having a first open end and a second open end which ends are closeable in pressure and fluid seal relation;

a substantially planar primary trackway including a first track at the first end, a second track extending through the chamber, and a third track at the second end;

a substantially planar secondary trackway external of the chamber and beneath the chamber and in a plane parallel to the plane of the primary trackway, wherein a portion of the primary trackway is movable between a position connecting the first, second and third tracks and a position connecting the first and third tracks with the secondary trackway; and a tram for the wood, said tram being movable along the primary and secondary trackways.

9. The apparatus as recited in claim 8, further comprising members for closing the first and second open ends of the chamber.

10. The apparatus as recited in claim 8, wherein the primary trackway is linear.

11. The apparatus as recited in claim 10, wherein the secondary trackway is linear.

12. The apparatus as recited in claim 11, wherein the portion is movable between a first position co-planar with the primary trackway and a second position at an angle to the primary and secondary trackways.

13. The apparatus as recited in claim 8, wherein the tram is movable along the primary trackway from the first track, along the second track, and to the third track, and movable from the third track back to the first track along the secondary trackway.

14. The apparatus as recited in claim 13, wherein the material treatment chamber is a pressurized fluid treatment chamber.

15. The apparatus as recited in claim 14, wherein the tram is wheeled and is loaded with the wood, when on the primary trackway, and which is not loaded with the wood, when on the secondary trackway.

16. The apparatus as recited in claim 14 wherein the primary trackway comprises, in successive order, a wood loading track as the first track, a track in the chamber as the second track, and a wood unloading track as the third track.

17. The apparatus as recited in claim 16 further comprising a fluid collector positioned only under the secondary trackway and the unloading track.

18. An apparatus, comprising:

a wood treatment chamber having a first open end and a second open end, which ends are closable in pressure and fluid seal relation;

a primary trackway extending from the first end, through the chamber and to the second end;

a secondary trackway external to and below the chamber, and being engageable with the primary trackway via a portion of the primary trackway pivotally movable between the primary and secondary trackways; and a wheeled tram for receiving wood and being movable along the primary trackway from the first end, through the chamber, to the second end, and from the second end along the secondary trackway to the first end.

19. The apparatus as recited in claim 18, wherein at least the portion of the primary trackway is linear.

20. The apparatus as recited in claim 19, wherein the secondary trackway is correspondingly linear and substantially parallel to the primary trackway.

21. The apparatus as recited in claim 20, wherein the portion is movable between a first position co-planar with the primary trackway and a second position at an angle to the primary and secondary trackways.

22. The apparatus as recited in claim 18, wherein the tram is articulated, is loaded with the wood at the first end, is movable in a first direction from the first end, through the chamber to the second end, along the primary trackway, is unloaded at the second end, and is movable in a second direction from the second end to the first end along the secondary trackway.

23. The apparatus as recited in claim 22, wherein the tram comprises a plurality of wheeled carts connected by pivoting joints.

24. The apparatus as recited in claim 22, wherein the tram is moved in the first direction by a first winch, and the tram is moved in the second direction by a second winch, the first winch, the first winch being more powerful than the second winch.

25. The apparatus as recited in claim 18, wherein the primary trackway comprises a wood loading track at the first end, a chamber track in the chamber, and a wood unloading track at the second end, and wherein the portion is two separately pivotable bridges, one of which is located between the loading track and the chamber track, and the other of which is located between the unloading track and the chamber track.

26. The apparatus as recited in claim 25, further comprising a fluid collector positioned only under the secondary trackway and the unloading track.

27. An apparatus for treating wood, comprising:

a pressurizable treatment chamber which can be opened and closed on both ends;

a substantially planar primary trackway including a first track at the first end, a second track in the chamber and a third track at the second end; and a substantially planar and separate secondary trackway located under the chamber in a plane different than the plane of the primary trackway;

wherein a portion of the primary trackway is pivotable to connect the first and third tracks with the secondary trackway; and a wheeled receiver for carrying wood movable along the primary trackway from the first track, along the second track, and to the third track, and movable from the third track back to the first track along the secondary trackway.

28. The apparatus as recited in claim 27, further comprising members for closing and opening the first and second open ends of the chamber.

29. The apparatus as recited in claim 27, wherein the primary trackway is linear.

30. The apparatus as recited in claim 29, wherein the secondary trackway is linear and in a plane parallel to the primary trackway.

31. The apparatus as recited in claim 30, wherein the portion is movable between a first position co-planar with the primary trackway and a second position at an angle to the primary and secondary trackways.

32. The apparatus as recited in claim 27, wherein the wheeled receiver is loaded with the wood, when on the primary trackway, and is not loaded with the wood, when on the secondary trackway.

33. The apparatus as recited in claim 27, wherein the primary trackway comprises, in successive order, a wood loading track as the first track, a track in the chamber as the second track, and a wood unloading track as the third track.

34. The apparatus as recited in claim 33, further comprising a fluid collector positioned only under the secondary trackway and the unloading track.

35. An apparatus, comprising:

a wood treatment chamber having a first open end and a second open end, which ends are openable and are closable in pressure and fluid seal relation;

a primary trackway extending from the first end, through the chamber and to the second end;

a separate secondary trackway under the chamber, and being engageable with the primary trackway via a portion of the primary trackway pivotally movable between the primary and secondary trackways; and a wheeled tram for carrying wood movable along the primary trackway from the first end, through the chamber, to the second end, and from the second end along the secondary trackway to the first end.

36. The apparatus as recited in claim 35, wherein the primary trackway is linear.

37. The apparatus as recited in claim 36, wherein the secondary trackway is correspondingly linear and substantially parallel to the primary trackway.

38. The apparatus as recited in claim 37, wherein the portion is pivotable between a first position co-planar with the primary trackway and a second position at an angle to the primary and secondary trackways.

39. The apparatus as recited in claim 35, wherein the tram is articulated, is loaded with wood at the first end of the primary trackway, is movable in a first direction from the first end of the primary trackway, through the chamber to the second end of the primary trackway, along the primary trackway, is unloaded at the second end of the primary trackway, and is movable in a second direction from the second end of the primary trackway to the first end of the primary trackway along the secondary trackway.

40. The apparatus as recited in claim 39, wherein the tram comprises a plurality of wheeled carts connected by pivoting joints.

41. The apparatus as recited in claim 39, wherein the tram is moved in the first direction by a first winch, and the tram is moved in the second direction by a second winch, the first winch being more powerful than the second winch.

42. The apparatus as recited in claim 35, wherein the primary trackway comprises a wood loading track at the first end, a chamber track in the chamber, and a wood unloading track at the second end, and wherein the portion is two separately pivotable bridges, one of which is located between the loading track and the chamber track, and the other of which is located between the unloading track and the chamber track.

43. The apparatus as recited in claim 42, further comprising a fluid collector positioned only under the secondary trackway and the unloading track.

44. An apparatus, comprising:

a material treatment chamber having a first open end and a second open end;

a substantially planar primary trackway including a first track at the first end, a second track in the chamber and a third track at the second end; and a substantially planar secondary trackway external of the chamber and locate a beneath the chamber and in a plane different than the plane of the primary trackway, wherein a portion of the primary trackway is movable to connect the first and third tracks with the secondary trackway, members for closing the first and second open ends of the chamber, a receiver movable along the primary trackway from the first track, along the second track, and to the third track, and movable from the third track back to the first track along the secondary trackway, wherein the material treatment chamber is a pressurized fluid treatment chamber and the material is wood, wherein the receiver is a wheeled tram which is loaded with the wood, when on the primary trackway, and which is not loaded with the wood, when on the secondary trackway, and wherein the primary trackway includes, in successive order, a material loading track as the first track, a track in the chamber as the second track, and a material unloading track as the third track.

45. The apparatus as recited in claim 44, wherein the primary trackway is linear.

46. The apparatus as recited in claim 45, wherein the secondary trackway is linear and in a plane parallel to the primary trackway.

47. The apparatus as recited in claim 46, wherein the portion is movable between a first position co-planar with the primary trackway and a second position at an angle to the primary and secondary trackways.

48. The apparatus as recited in claim 44, further comprising a fluid collector positioned only under the secondary trackway and the unloading track.

49. An apparatus for treating wood, comprising:

a treatment chamber which can be opened and sealed closed on both ends which ends are closeable in pressure and fluid seal relation;

a substantially planar primary trackway including a first wood loading track at the first end, a second track in the chamber and a third wood unloading track at the second end;

a substantially planar and separate secondary trackway located under the chamber in a plane different than the plane of the primary trackway;

wherein a portion of the primary trackway is pivotable to connect the first and third tracks with the secondary trackway;

a wheeled receiver for carrying wood movable along the primary trackway from the first track, along the second track, and to the third track, and movable from the third track back to the first track along the secondary track; and wherein the portion is movable between a first position co-planar with the primary trackway and a second position at an angle to the primary and secondary trackways;

a fluid collector positioned only under the secondary trackway and the third wood unloading track.

50. The apparatus as recited in claim 49, further comprising a first winch for moving the wheeled receiver along the primary trackway, and a second winch for moving the wheeled receiver along the secondary trackway, wherein the first winch is more powerful than the second winch.

51. An apparatus, comprising:

a wood treatment chamber having a first open end and a second open end, which ends are openable and are closable in pressure and fluid seal relation;

a primary trackway extending from the first end, through the chamber and to the second end;

a separate secondary trackway under the chamber, and being engageable with the primary trackway via a portion of the primary trackway pivotally movable between the primary and secondary trackways;

a wheeled tram for carrying wood movable along the primary trackway from the first end, through the chamber, to the second end, and from the second end along the secondary trackway to the first end, wherein the portion is pivotable between a first position co-planar with the primary trackway and a second position at an angle to the primary and secondary trackways; and a fluid collector positioned only under the secondary trackway and the second end.

52. The apparatus as recited in claim 51, wherein the tram is moved along the primary trackway by a first winch, and the tram is moved along the secondary trackway by a second winch, the first winch being more powerful than the second winch.

* * * * *